United States Patent [19]

Barr

[11] 4,144,654

[45] Mar. 20, 1979

[54] DRYING APPARATUS

[75] Inventor: Derek J. Barr, London, England

[73] Assignee: Barr & Murphy Limited, London, England

[21] Appl. No.: 763,541

[22] Filed: Jan. 28, 1977

[30] Foreign Application Priority Data

Feb. 10, 1976 [GB] United Kingdom ..... 5226/76

[51] Int. Cl.[2] ..... F26B 3/00

[52] U.S. Cl. ..... 34/33; 34/168; 34/169; 34/179; 432/14; 432/101

[58] Field of Search ..... 34/33, 166, 167, 168, 34/179, 169; 432/14, 15, 101

[56] References Cited

U.S. PATENT DOCUMENTS

| | | | |
|---|---|---|---|
| 552,127 | 12/1895 | Howie | 34/168 |
| 1,308,942 | 7/1919 | French | 34/167 X |
| 4,008,994 | 2/1977 | Numasaki et al. | 34/168 |

*Primary Examiner*—John J. Camby

*Attorney, Agent, or Firm*—Wenderoth, Lund & Ponack

[57] ABSTRACT

Granular solid material is dried in a vertically extending annular chamber formed between inner and outer cylindrical walls by a current of high temperature inert drying gas of high humidity passed downward through the material. Material enters the chamber under gravity through a slot in the inner wall, which slot extends round the full periphery of the inner wall, and is removed from the bottom of the chamber by a variable speed discharge system, the rate of entry through the slot being governed by the rate of discharge from the bottom of the chamber so that the top of the column of material is of frusto-conical form. The spent drying gas stream, less a quantity which is discharged, is used to dilute the products of a fuel in air, the high temperature mixture thus formed constituting the drying gas. The quantity discharged has a mass equal to that of the fuel and air forming the products of combustion. An upward current of cooling air may be passed through the lower portions of the column of material.

8 Claims, 3 Drawing Figures

DRYING APPARATUS

This invention relates to a method of an apparatus for drying granular solid materials which are in pieces small enough to flow easily under the influence of gravity and large enough to permit easy passage of air or other gas freely through a colunm of the material in a vessel.

According to the present invention, there is provided a method of drying a vertical annular column of granular solid material enclosed in a vessel comprising the step of passing a current of drying gas downward through the material, withdrawing dried material from the bottom of the column, and adding fresh material at the top of the column in such a manner that the top surface of the column is maintained in substantially frusto conical form, having an angle of conicity corresponding to the angle of repose of the material added.

The invention also provides a drying apparatus comprising inner and outer vertical cylindrical walls forming between them an annular drying chamber, the inner cylindrical wall having a circumferential slot therein adjacent the upper end of the chamber and being open at its upper end to receive granular material to be dried, and a guide surface within the inner wall for guiding the granular material through the circumferential slot, whereby the column of material in the chamber has a frusto-conical top surface whereof the angle is determined by the angle of repose of the material, means for passing a current of drying gas downward through the material from the upper end of the drying chamber, and means for discharging dried material from the lower end of the chamber.

In a preferred construction, the guide surface is formed by a fixed conical member disposed within the inner cylinder with its lower edge at the lower edge of the circumferential slot.

The vertical dimension of the slot through which the material is introduced into the chamber is preferably adjustable.

Thus, drying gas, usually air, is introduced into the chamber above the column of material and is caused to pass-co-currently with the material. The rate of movement of the material is controlled by the discharging means at the lower end of the chamber, and the supply of new material through the column is so arranged that a fresh layer of moist product is continuously deposited at the top surface of the column. Hot air may, if desired, be passed downwardly through the whole length of the column of material, but in preferred arrangements a counter-current of cold air is introduced into the column at or near the bottom of the column to cool the dried material before it is discharged.

In one form of apparatus according to the invention, the upwardly flowing cooling air and the downwardly flowing drying gas are withdrawn through exit ducts so arranged that the column is divided into three portions the upper portion being a drying zone, the middle portion being a conditioning zone, and said lower portion being a cooling zone.

In preferred arrangements the means for discharging the dried material is adjustable to control the rate of discharge.

In the said one form of the apparatus the exit ducts extend radially across the chamber and open through the inner cylinder or through the outer cylinder to a suction device.

In a further aspect, the invention provides drying apparatus comprising inner and outer vertical cylindrical walls forming between them an annular drying chamber, said chamber having at or adjacent its upper end an inlet for the material to be dried and having at its lower end means for discharging the material comprising a plate which extends across the chamber and has apertures therein, deflecting members spaced above the plate and from each other which members are disposed above the apertures so as to deflect the material into the spaces between the members and to prevent the material from dropping from the chamber through the apertures and a bladed rotor disposed in the space between the deflecting members and the plate and arranged to rotate to sweep the material falling between the members under the members to enable it to fall through the apertures in the plate.

Some embodiments of the invention will now be described, by way of example, with reference to the accompanying diagrammatic drawings in which.

Figure 1:
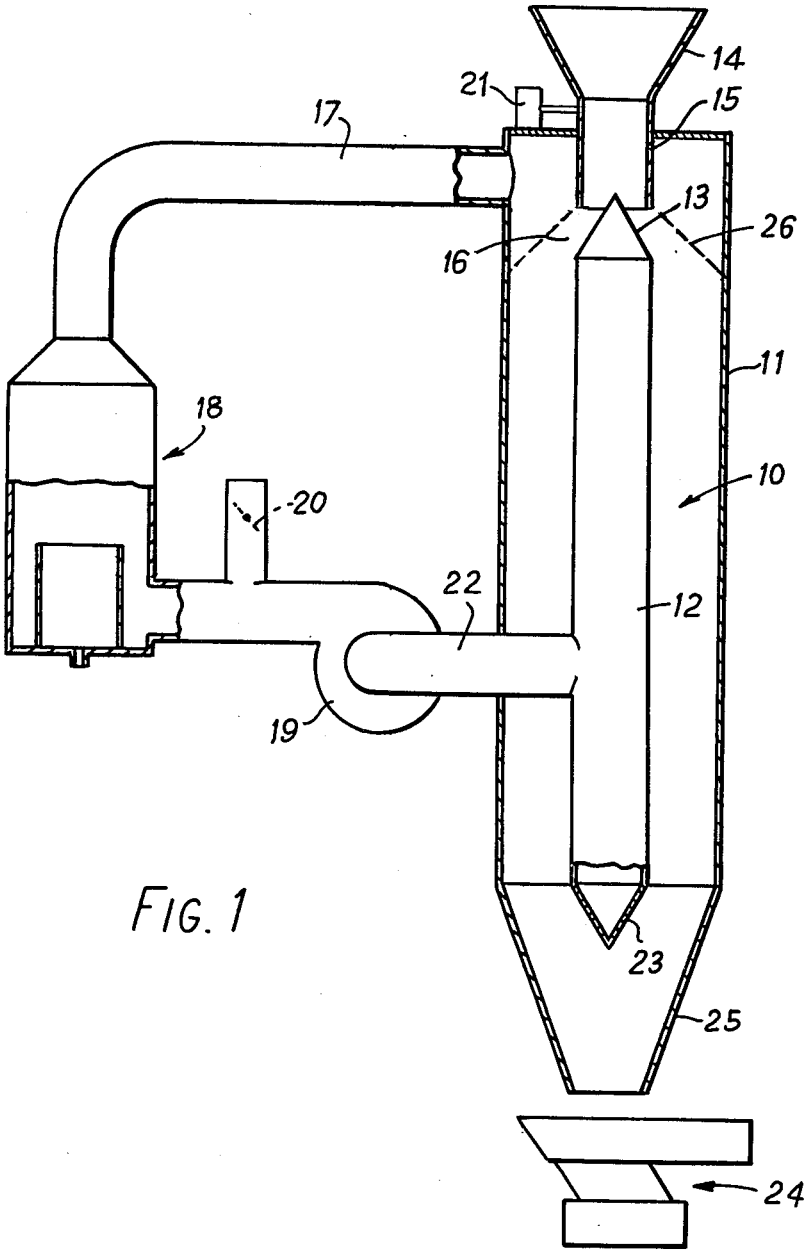
FIG. 1 shows in axial section one form of apparatus according to the invention.
Figure 2:
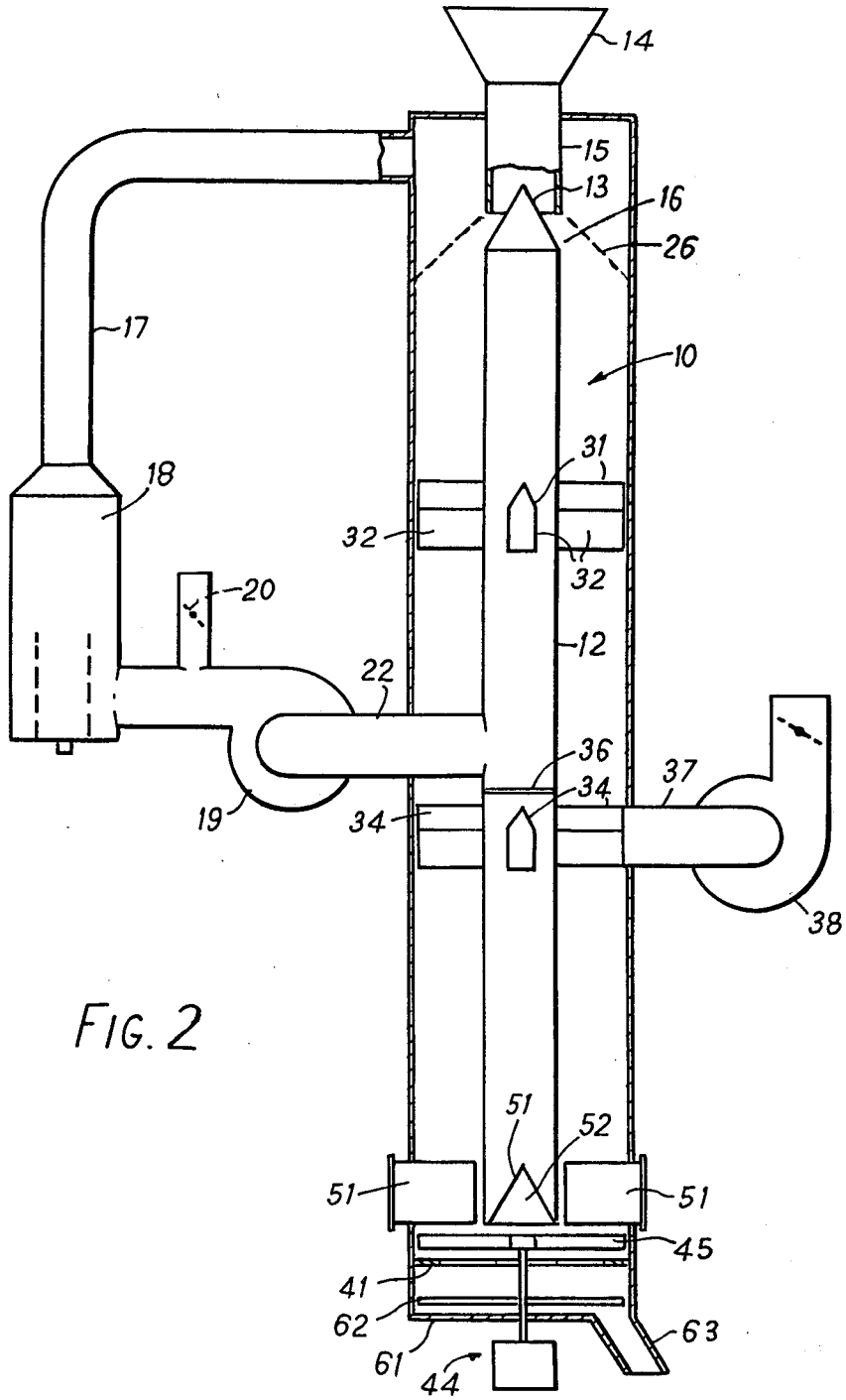
FIG. 2 shows in axial section a preferred form of apparatus according to the invention.

The method of the invention will be understood from the following description of FIGS. 1 and 2 of the drawings.

Referring first to FIG. 1, a drying chamber 10 is defined between outer and inner cylinders 11 and 12, which are vertical. A hopper 14 has a cylindrical outlet conduit 15 extending downwardly through the closed top of cylinder 11 and in line with and of the same diameter as cylinder 12 so as effectively to form a continuation of the cylinder 12 but terminating above that cylinder to define a circumferential slot 16 opening to the chamber. The cylinder 12 has a conical wall 13 across its upper end, the lip of the wall being joined to the top edge of the cylinder. The dimensions of the slot may be made adjustable, for example by a device 21 operable for and lowering conduit 15.

A hot air inlet pipe 17 opening to the top of the drying chamber is connected in flow series with an air heater 18, and a fan 19. A duct 22 leads from the inner cylinder 12 to the inlet of fan 19.

The inner cylinder 12 is provided with a perforated conical member 23 at its lower end, and a gaseous drying medium is drawn by fan 19 through these perforations into the inner cylinder 12, thus producing a downward flow of drying medium through the whole length of the column of material disposed in the drying chamber 10. An adjustable rate conveyor 24 carries the dried material from a bottom frusto-conical section 25 of the cylinder 11 and fresh wet material enters through the slot 16 at the same rate as the material is withdrawn at the bottom of the section 25.

The fan 19 draws drying medium from the inner cylinder and returns the major portion of the medium, after reheating, to the top of the drying chamber through pipe 17. If the heater 18 is a gas-fired furnace, the spent drying medium can be used as diluting gas combined with the products of combustion. In this fashion a closed-circuit of inert drying medium of high humidity is maintained in the system with only a small bleed-off equivalent to the mass of the air and fuel added in the furnace 18. The bleed-off is controlled by a valve 20 disposed between fan 19 and furnace 18. This arrangement affords use of high temperatures without danger or oxidation, and excellent fuel economy.

FIG. 2 illustrates another application of the method according to this invention, parts corresponding to parts shown in FIG. 1 being indicated by the same reference numerals. Again the product descends slowly under gravity in the annular space between cylinders 11 and 12, entering through opening 16 and forming the top of the column of material as a frusto-conical surface 26 having an inclination substantially equal to the angle of repose of the product.

In this form of the apparaus, however, the drying air is withdrawn through a set of ducts 31 which are arranged radially and open into the inner cylinder. The ducts 31 are ridged in order to allow easy passage of the product, and the side walls 32 of the ducts are perforated and are covered with gauze preventing the escape of fines. As in the arrangement of FIG. 1, the inner cylinder 12 communicates through a duct 22 with the inlet of a fan 19 which preferably passes back most of the spent drying medium to the furnace 18 of the system for reheating and re-circulation through the duct 17, thus maintaining in the drying zone a high temperature inert atmosphere having a high dew point.

At a lower level a second set of radially extending ducts 34, similar to the ducts 31, extends across the annular space between cylinder 11 and 12. These ducts 34 are ridged and provided with perforated gauze covered side walls and communicate with a lower part of the innder cylinder 12 which is partitioned from the upper part by a transverse wall 36. An exhaust duct 37 is connected to the other end of one of the ducts 34 and leads to a fan 38 which draws a current of cooling air upwards through the bottom section of the drying column, ducts 34 and duct 37 and passes the spent cooling air to atomsphere. Wall 36 keeps the cooling air separate from the drying medium.

Figure 3:
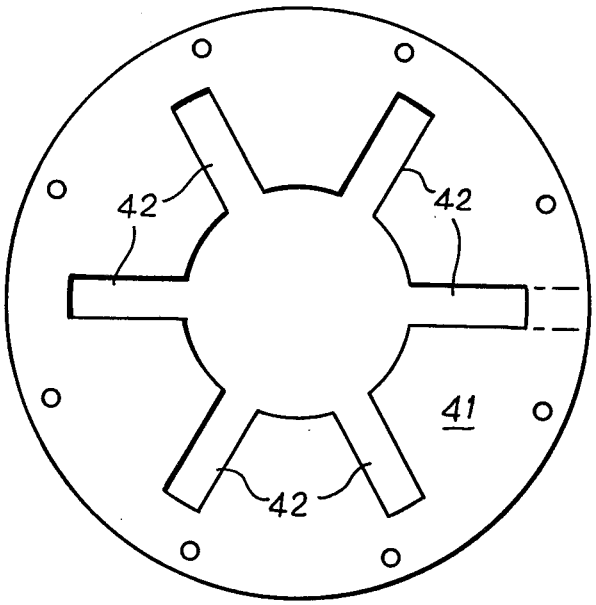
FIG. 3 is a plan view of a bottom plate of the apparatus of FIG. 2.

The inner cylinder is closed at the bottom end by a transverse wall. A bottom plate 41 spaced below the transverse wall extends across the bottom of the chamber 10 and has a number of radial slots 42 for the discharge of the material as shown in FIG. 3 of the drawings. In order to prevent gravity flow of the material through the slots 41, ridged deflecting members 51 are spaced above the plate 41 and are disposed directly above the slots. In order to control the rate of discharge of the product, a rotary sweeper 44 with a number of blades 45 is provided in the space between plate 41 and the members 51 for sweeping the dried material falling between the members 51 over the bottom plate to the nearest slots in the bottom plate. The speed of the sweeper is adjustable.

The space below the ridges 51 serves as an inlet for the cooling air of the lower part of the column, and openings 52 are provided in the outer cylinder 11 for entry of the cooling air. The surfaces of the members 51 are perforated and covered with gauze in order to allow cooling air to enter the chamber 10 while preventing material from entering the cooling air space.

A second bottom plate 61 is spaced below the plate 41 and a second set of sweeper blades mounted on the same shaft as the blades 45 is provided for final discharge of dried and cooled product through an aperture in plate 61 to a chute 63.

The invention is applicable to the drying of many products including ores, cereal grains of all kinds, and coal, particularly in the size range 3mm to 30mm.

I claim:

1. A method of drying a vertical annular column of granular solid material enclosed in a vessel comprising the steps of passing a current of drying gas downward through the material, withdrawing dried material from the bottom of the column, and adding fresh material at the top of the column and maintaining the top surface of the column in substantially frusto-conical form, having an angle of conicity corresponding to the angle of repose of the material added.

2. A method as claimed in claim 1, further comprising continously withdrawing from the vessel the gas which has been passed downward through the material, continuously discharging part of the withdrawn gas to atmosphere, and continuously mixing hot dryer gas with the remaining part of the withdrawn gas thereby to reconstitute the current of drying gas to be passed downward through the material.

3. A method as claimed in claim 2, further comprising burning a fuel in air and employing the hot products of such combustion as said hot dryer gas.

4. A method as claimed in claim 1, further comprising passing a current of cooling air upwardly through the material in the lower portion of the column.

5. A drying apparatus comprising inner and outer vertical cylindrical walls forming between them an annular drying chamber, a granular material supply member having a cylindrical portion depending into the upper end of said annular drying chamber and defining with the upper end of said inner cylindrical wall a circumferential slot adjacent the upper end of the chamber, said supply member being open at its upper end to receive granular material to be dried, and a guide surface adjacent said slot for guiding the granular material through the circumferential slot, whereby the column of material in the chamber has a frusto-conical top surface the angle of which is determined by the angle of repose of the material, means for passing a current of drying gas downward through the material from the upper end of the drying chamber, means for discharging dried material from the lower end of the chamber, and further comprising means for causing an upward current of cooling air to flow through the lower portion of the column to cool the dried material before it is discharged.

6. Drying apparatus as claimed in claim 5, further comprising exit ducts for withdrawing the upwardly flowing cooling air and the downwardly flowing drying gas said ducts being positioned for dividing the column into three portions, the upper portion being a drying zone, the middle portion being a conditioning zone, and said lower portion being a cooling zone.

7. Drying apparatus as claimed in claim 6, wherein the exit ducts extend radially across the chamber and open through the inner cylindrical wall and through the out cylindrical wall, and a suction device connected to said ducts outside of the outer cylindrical wall.

8. A drying apparatus comprising inner and outer vertical cylindrical walls forming between them an annular drying chamber, a granular material supply member having a cylindrical portion depending into the upper end of said annular drying chamber and defining with the upper end of said inner cylindrical wall a circumferential slot adjacent the upper end of the chamber, said supply member being open at its upper end to receive granular material to be dried, and a guide surface adjacent said slot for guiding the granular material through the circumferential slot, whereby the column of material in the chamber has a frusto-conical top surface the angle of which is determined by the angle of repose of the material, means for passing a current of drying gas downward through the material from the upper end of the drying chamber, means for discharging dried material from the lower end of the chamber, wherein the chamber has a bottom wall with apertures therein and said apparatus further comprises circumferentially spaced deflecting members which are spaced above the apertures in said bottom wall and extend radially across the lower end of the chamber between the inner and outer cylindrical walls and deflect the dried material circumferentially to prevent it from falling directly through the apertures, and a bladed rotor disposed between the bottom wall and the deflecting members for sweeping the dried material falling between the deflecting members to said apertures to discharge the material from said lower end of the drying chamber.

* * * * *